United States Patent [19]

Phillips et al.

[11] Patent Number: 4,857,162

[45] Date of Patent: Aug. 15, 1989

[54] CHROMIUM SOLUTION REGENERATOR

[75] Inventors: Pettice M. Phillips, Bedford; Billy J. Swink, Euless, both of Tex.

[73] Assignee: Lockheed Corporation, Calabasas, Calif.

[21] Appl. No.: 233,464

[22] Filed: Aug. 18, 1988

[51] Int. Cl.[4] ..... C25B 15/08; C25B 9/00; C25B 13/00; C25D 17/00

[52] U.S. Cl. ..... 204/257; 204/263; 204/279; 204/282

[58] Field of Search ..... 204/257, 282, 252–256, 204/258, 263–266, 237

[56] References Cited

U.S. PATENT DOCUMENTS

| | | | |
|---|---|---|---|
| 2,265,645 | 12/1941 | Johnson et al. | 204/257 |
| 2,271,341 | 1/1942 | Johnson et al. | 204/257 |
| 2,578,839 | 12/1951 | Renzoni | 204/263 |
| 4,287,046 | 9/1981 | Ueda et al. | 204/282 X |
| 4,302,304 | 11/1981 | Ueda et al. | 204/151 X |
| 4,337,129 | 6/1982 | Soboroff et al. | 204/151 |
| 4,455,209 | 6/1984 | Hermann | 204/282 X |
| 4,595,477 | 6/1986 | Detournay et al. | 204/282 X |

*Primary Examiner*—Donald R. Valentine
*Attorney, Agent, or Firm*—Robert P. Barton

[57] ABSTRACT

A chromium regeneration apparatus (10) is disclosed for regenerating spent chromium solution by oxidizing trivalent chromium to hexavalent chromium. The apparatus is provided with a tank (42) forming a reservoir full of spent chromium solution. A number of anode assembles (46) are supported on the tank within the reservoir with each assembly including two frame sections (70, 72) bolted together along their sides and bottom with two separate cation selective membranes (100, 102) secured therebetween. Membrane tensioners (104) are inserted between the membranes to separate them and urge them against the frame sections over openings in the frame sections to define an anode chamber. An anode and cathode are provided to a generate a current flow therebetween to regenerate the solution.

7 Claims, 6 Drawing Sheets

CHROMIUM SOLUTION REGENERATOR

TECHNICAL FIELD

This invention relates to an apparatus for the regeneration of a chromium solution by oxidizing trivalent chromium to hexavalent chromium.

BACKGROUND OF THE INVENTION

Chromium acid solutions containing hexavalent chromium are used in a number of industrial processes. For example, such processes include chrome plating, copper stripping, aluminum anodizing, corrosion inhibition, photography, purification of oil and acetylene, hardening materials, and as an oxident in organic chemical reactions.

Over time, the chromium solution loses effectiveness in the chemical process because the active hexavalent chromium is chemically converted into the trivalent form. In the past, the solution eventually became ineffective due to the presence of trivalent chromium and was disposed of as waste. This generated a significant environmental problem and cost.

U.S. Pat. No. 4,337,129, issued June 29, 1982 presents a method for the regeneration of spent chromium solution. The method included the presence of a spent chromium solution within an anode compartment, which is separated from a cathode compartment by a cation selective membrane. An electrical potential is created between an anode in the anode compartment and a cathode in the cathode compartment. The current flow between the anode and cathode oxidizes the trivalent chromium to the desired hexavalent form and regenerates the chromium solution in the anode compartment for reuse. Further details of the method are set forth in a United States Department of the Interior, Bureau of Mines Report of Investigations 8377, entitled "Regeneration and Recycling of Waste Chromic Acid-Sulphuric Acid Etchants."

Under a cooperative agreement with the Bureau of Mines, Bell Helicopter Textron, Inc. undertook an application of the basic method disclosed in U.S. Pat. No. 4,337,129. Details and results of that effort are published in a paper entitled "Recovery and Recycling of Chromium-Bearing Solutions" by L. C. George, M. L. Rogers and Glenn L. Horter.

While an effective method thus exists for regeneration of spent chromium solution, a need exists for an effective apparatus or device for efficiently practicing this method.

SUMMARY OF THE INVENTION

In accordance with one aspect of the present invention, a chromium regeneration apparatus is provided. The apparatus includes a tank having a fluid reservoir and an anode assembly mounted on the tank and within the fluid reservoir. The anode assembly includes a frame, a cation selective membrane and a membrane tensioner. The frame defines an opening therethrough with a portion of the frame forming a continuous periphery about the opening. The cation selective membrane is positioned over the opening and is tensioned against the frame about the periphery by the membrane tensioner to define an anode chamber within the fluid reservoir. An anode is suspended in the anode chamber, while a cathode is suspended in the fluid reservoir proximate the anode assembly. Structure is provided for generating an electrical potential between the anode and cathode. Structure is provided to supply depleted chromium solution to the bottom of the anode chamber and to the fluid reservoir. The current flow between the anode and cathode oxidizes the trivalent chromium in the depleted chromium solution in the anode chamber to regenerate the chromium solution by forming hexavalent chromium. The regenerated chromium solution has a lesser density than the depleted chromium solution and rises above the depleted chromium solution in the anode chamber. Structure is provided for draining the regenerated chromium solution from the top of the anode chamber for reuse.

In accordance with another aspect of the present invention, the anode assembly includes first and second frame portions and first and second cation selective membranes. Each frame portion has sides, a bottom and a top. Each frame portion also has at least one opening formed therethrough within the confines of the frame portion. Structure is provided for securing the first and second frame portions together along their sides and bottom with the first and second cation selective membranes therebetween and extending over the openings through the frame portions. Each frame portion has vertically oriented slots extending outward of the plane of the opening therein on either side of the opening, the slots generally extend the height of the opening. A membrane tensioner is inserted between each membrane and into facing slots on the mated frame portions to tension the membranes and hold the first membrane against the first frame portion about the opening therethrough and the second membrane against the second frame portion about the opening therethrough.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION

Figure 1:
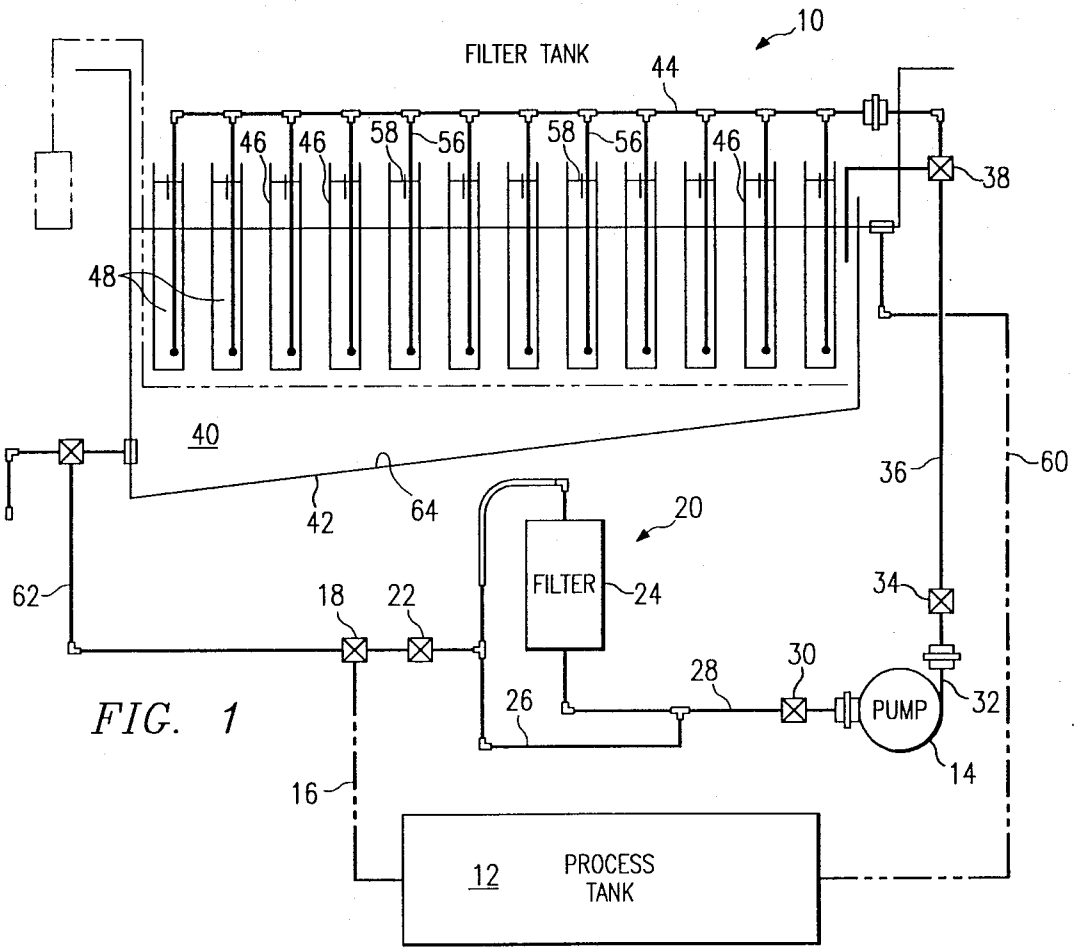
FIG. 1 is a flow diagram of a chromium regeneration apparatus forming a first embodiment of the present invention.
Figure 2:
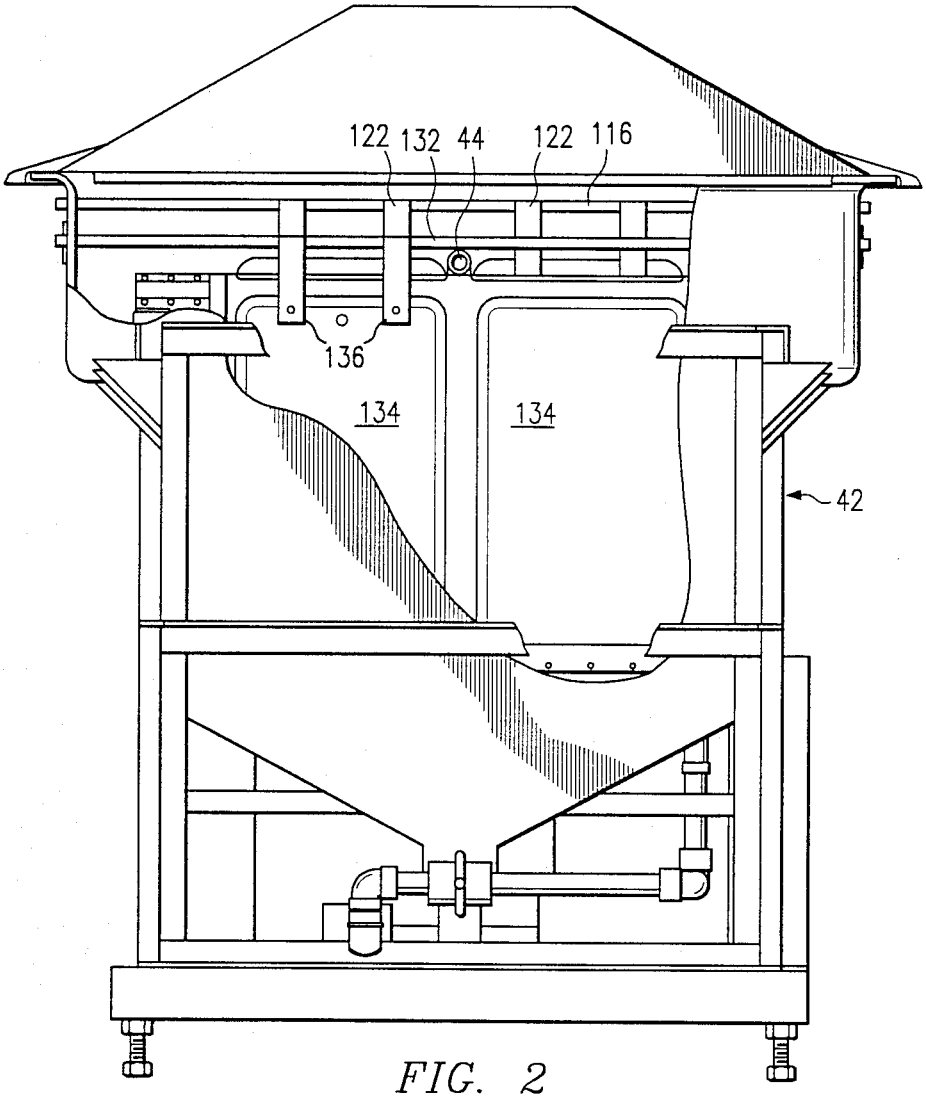
FIG. 2 is an end view, in partial cross section, of the apparatus.
Figure 3:
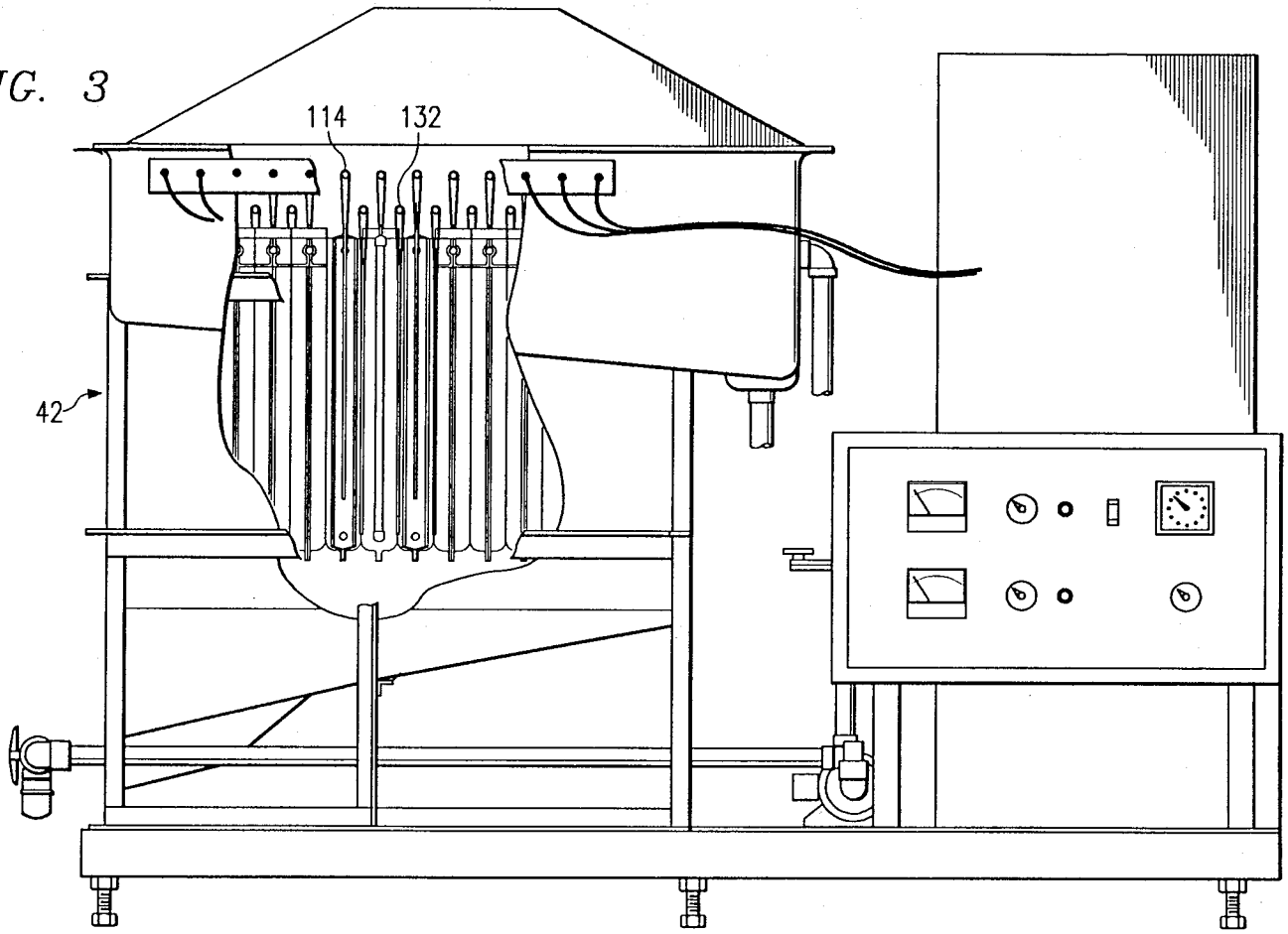
FIG. 3 is a side view, in partial cross section, of the apparatus.

With reference now to the drawings, and in particular to FIG. 1, a chromium regeneration apparatus 10 is illustrated which forms a first embodiment of the present invention. The apparatus, as will be discussed in greater detail hereinafter, utilizes the method disclosed and claimed in U.S. Pat. No. 4,337,129, issued June 29, 1982 to regenerate a chromium solution by oxidizing trivalent chromium ions to form the hexavalent chromium form for reuse in a chemical process. U.S. Pat. No. 4,337,129 is herein incorporated by reference in its entirety as if the entire specification was st out hereinafter.

The apparatus 10 cooperates with a process tank 12 which employs the chromium solution in a particular chemical process which results in the depletion of hexavalent chromium. For example, process tank 12 can be used to etch metal components, such as aircraft structure. As will be described hereinafter, the apparatus 10 can be used, if desired, to continuously regenerate the chromium solution used in the process tank 12 to maximize the efficiency of the process undertaken within the tank 12. Furthermore, the regeneration of the chromium solution greatly reduces the waste disposal problem for the process using the chromium solution.

The depleted chromium solution is withdrawn from the process tank 12 by a pump 14. The fluid is withdrawn from the tank through line 16 and three-way valve 18 into a filter assembly 20. The filter assembly 20 includes a three-way valve 22 which allows the fluid to be selectively passed through a filter 24 or through a bypass 26 should the fluid not need filtering, or the filter be clogged. From the filter assembly 20, the fluid passes through a line 28 and two-way valve 30 into the inlet of the pump 14.

The outlet of the pump is directed along line 32 and through a two-way valve 34. From two-way valve 34, the flow continues along line 36 to a three-way valve 38. The three-way valve 38 permits selective delivery of the depleted chromium solution into a reservoir 40 formed within a tank 42, or to a manifold 44 extending along the top of the tank 42.

A series of anode assemblies 46 are suspended from the tank and extend into the reservoir 40 of the tank. Each anode assembly defines therein an anode chamber 48 which communicates with the reservoir at large through a series of cation selective membranes 50. An anode 52 is positioned in each anode chamber while cathodes 54 are suspended in the reservoir from the tank between each anode assembly.

As can be seen in FIG. 1, a line 56 extends from the manifold 44 into each anode assembly near the bottom of the anode chamber 48 therein.

As described in detail in U.S. Pat. No. 4,337,129, an electrical potential can be established between the anodes and cathodes which causes a current to flow therebetween. The depleted chromium solution in each anode chamber is regenerated by the chemical effect resulting from the current flow by converting trivalent chromium in the depleted chromium solution to hexavalent chromium.

The regenerated chromium solution containing a higher portion of hexavalent chromium has a lesser density than the depleted chromium solution. Thus, the regenerated chromium solution will rise in each anode chamber toward the surface 58 in each chamber. The regenerated chromium solution is collected from each anode chamber near the surface 58 for return in line 60 to the process tank 12 for reuse.

As the fluid within the reservoir 40 surrounding the anode assemblies is drawn directly from the process tank, that fluid can be withdrawn as desired from tank 42 into line 62 which connects with three-way valve 18. Thus, the solution in the tank reservoir 40 can be recirculated frequently enough to essentially correspond to the fluid within the process tank 12.

The tank 42 preferably has a sloped bottom 64 which causes metallic elements and other debris settling out of the solution to collect at the low end for easy disposal.

Figure 4:
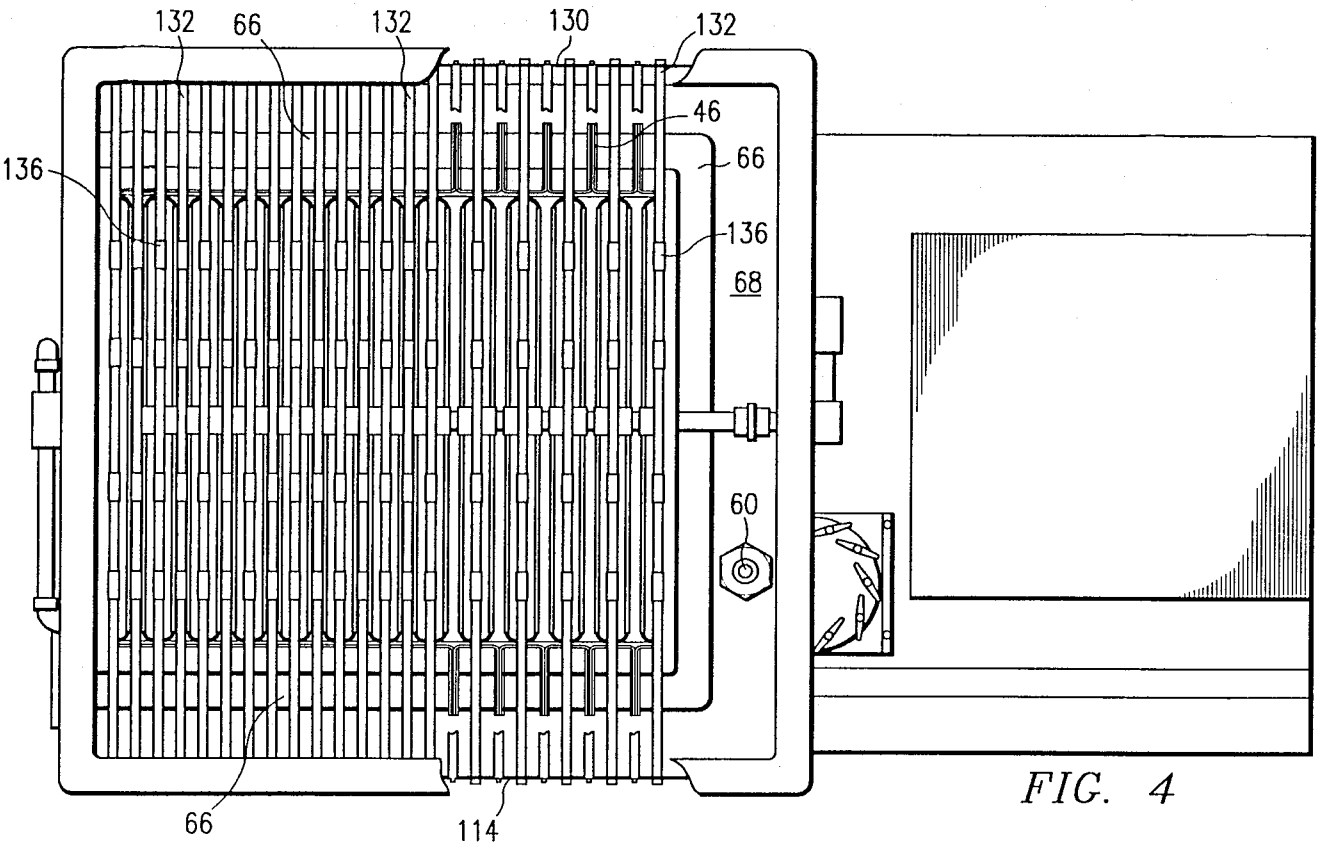
FIG. 4 is a top view of the apparatus.

With reference now to FIGS. 2 through 8, details of the regeneration tank 42 will be described. The tank 42, as best seen in FIG. 4, has an elevated internal rim 66 which extends along both sides and one end of the tank and separates the reservoir 40 from a trough 68. The rim 66 supports the individual anode assemblies 46 and the trough 68 collects the regenerated chromium solution for delivery to the return line 60.

Figure 6:
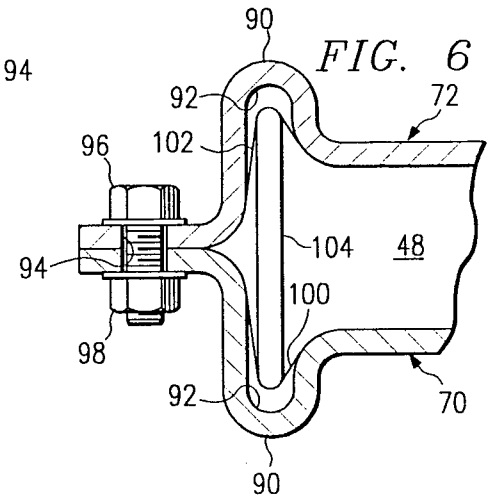
FIG. 6 is a top view of a membrane tensioner employed in the apparatus.
Figure 5:
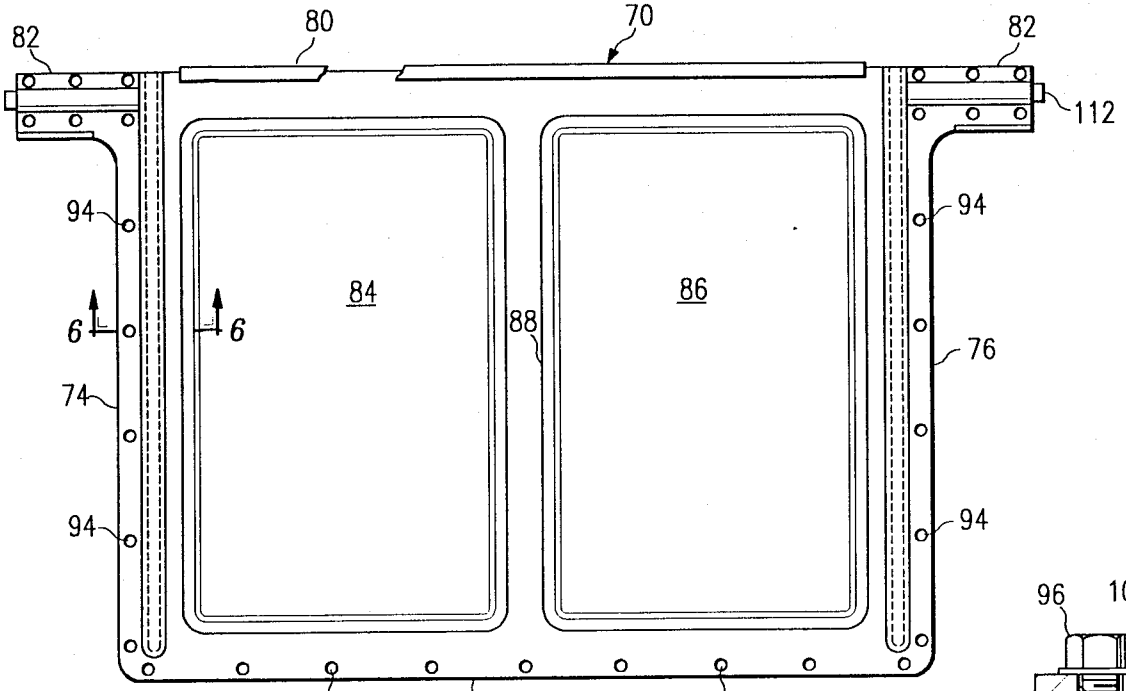
FIG. 5 is a side view of a frame section employed in the apparatus.
Figure 7:
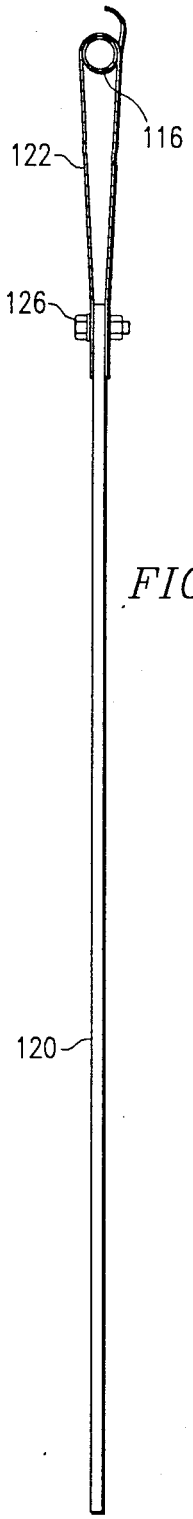
FIG. 7 is a side view of an anode chamber used in the apparatus.

With reference particularly to FIGS. 5, 6, and 7, each anode assembly can be seen to include a first frame section 70 and a second frame section 72. The frame sections can be identical if desired, reducing the overall cost of the apparatus. Each frame section includes sides 74, 76, a bottom 78, a top 80 and extensions 82 to bear on rim 66. Each frame section includes openings 84 and 86 formed therethrough entirely within the confines of the frame section and separated by a bridging portion 88.

As best seen in FIG. 6, each frame section is formed into a U-shape 90 between each side thereof and the adjacent opening to define a vertical slot 92 extending outward of the plane of the openings in the frame section.

Each frame section has a plurality of bolt holes 94 formed in the sides, bottom and extensions thereof which align with corresponding bolt holes in the other frame section to permit the sections to be bolted together by a series of bolts 96 and nuts 98. A first cation selective membrane 100 and a second cation selective membrane 102 are positioned between the first and second frame sections and secured therebetween as the sections are bolted together, with the first cation selective membrane overlying the openings in the first frame section and the second cation selective membrane overlying the openings in the second frame section. Membrane tensioners 104 can be inserted between membranes 100 and 102 and into the now facing slots 92 of the frame sections, as seen in FIG. 6, to tension each membrane against the portions of the frame sections surrounding the openings. This design very effectively creates anode chamber 48 between the membranes 100 and 102.

Figure 8:
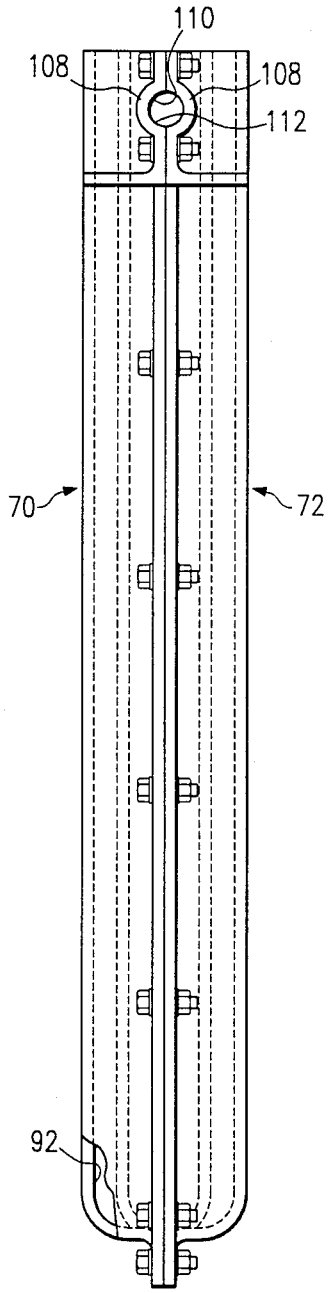
FIG. 8 is a side view of an electrode suspension for the apparatus.

As seen in FIG. 8, the extension 82 of each frame section has a horizontal semi-cylindrical molding 108. When the frame sections are bolted together, the facing moldings 108 together define a horizontal circular passage 110 which receives a line 112 to fluidly connect the upper portion of the anode chamber 48 with the trough 68. The regenerated chromium solution thus drains through line 112 from the upper portion of the anode chamber 48 to the trough 68, and from there back to the process tank.

With reference now to FIGS. 2–4 and 8, the mounting of the electrodes within the apparatus will be described. An anode bus bar 114 extends along one side of the tank 42 and supports a series of anode bars 116 which extend across the tank, with one anode bar extending directly above each of the anode chambers. An insulated support member 118 on the opposite side of bus bar 114 supports the opposite ends of the anode bars. Individual anode plates 120, preferably two for each anode chamber, are suspended from the anode bars by conductive straps 122, as seen in FIG. 7. The straps are secured to each anode plate by bolts 126 and nuts 128.

A cathode bus bar 130 is mounted on the side of tank 42 opposite anode bus bar 114. Cathode bus bar 130 supports the ends of a series of cathode bars 132 which extend across the tank, with one cathode bar extending above each gap between adjacent anode assemblies and the ends of the tank 42. Cathode plates 134, preferably two for each cathode bar, are suspended in the reservoir 40 between adjacent anode assemblies by conductive straps 136 using bolts 126 and nuts 128 in a manner identical to the anode plates.

It will be appreciated that the apparatus 10 provides a very efficient and effective apparatus for regenerating chromium solution by establishing a electrical potential between each cathode and anode to create a current flow therebetween to oxidize the trivalent chromium in the depleted chromium solution to hexavalent form and recovering the regenerated chromium solution for reuse. In one device constructed in accordance with the teachings of the present invention, the frame sections were a molded plastic material. The membrane tensioners were formed of Teflon, as were lines 112. All nuts and bolts employed in the device were of fiberglass to resist corrosion. The cation selective membranes were formed of perfluorosulfonic acid materials sold by DuPont Company, Polymer Products Department, Wilmington, Del., 19898 under the trademark "Nafion". The apparatus was provided with sufficient electrical power to achieve current densities within the range set out in U.S. Pat. No. 4,337,129.

Although a single embodiment of the invention has been illustrated in the accompanying drawings described in the foregoing Detailed Description, it will be understood that the invention is not limited to the embodiment disclosed, but is capable of numerous rearrangements, modifications and substitutions of parts and elements without departing from the scope and spirit of the invention.

We claim:

1. A chromium regeneration apparatus, comprising:

a tank having a fluid reservoir;

an anode assembly mounted in the fluid reservoir, the anode assembly having a frame, a cation selective membrane, and a membrane tensioner, the frame defining an opening therethrough with a portion of the frame forming a continuous periphery about the opening, the cation selective membrane positioned over the opening and being tensioned against the periphery of the frame by the membrane tensioner to define an anode chamber;

an anode suspended in the anode chamber;

a cathode suspended in the reservoir proximate the anode assembly;

means for generating an electrical potential between the anode and cathode;

means to supply a depleted chromium solution to the bottom of the anode chamber and the fluid reservoir external the anode chamber, the current flowing between the anode and cathode oxidizing trivalent chromium in the depleted chromium solution within the anode chamber to regenerate the chromium solution by forming hexavalent chromium, the regenerated chromium solution having a lesser density than the depleted chromium solution and rising above the depleted chromium solution in the anode chamber; and means for draining off the regenerated chromium solution from the anode chamber.

2. The chromium regeneration apparatus of claim 1 wherein the anode assembly includes first and second frame portions and first and second cation selective membranes, each of said frame portions defining sides, a top and a bottom, and defining an opening therethrough within the confines of the frame portion;

the apparatus further comprising means for securing the first and second frame portions together along their sides and bottom with said first and second cation selective membranes therebetween, the first cation selective membrane extending over the opening in the first frame portion and the second cation selective membrane extending over the opening in the second frame portion;

each frame portion having a vertically oriented slot extending outwardly of the plane of the opening therein on either side of the opening and extending generally the height of the opening; and a membrane tensioner inserted between the first and second cation selective membranes into each slot to tension the membranes against the frame portions to define an anode chamber.

3. The chromium regeneration apparatus of claim 1 wherein the tank defines a rim separating the reservoir from a trough, the trough for recovery of the regenerated chromium solution.

4. The chromium regeneration apparatus of claim 3 wherein the anode assembly has extensions for resting on the rim to support the anode assembly in the tank, said extensions including at least one horizontal passage innerconnecting the anode chamber with the trough for passage of regenerated chromium solution to the trough.

5. The chromium regeneration apparatus of claim 1 wherein the membrane tensioner is formed of teflon.

6. A chromium regeneration apparatus, comprising:

a tank having a fluid reservoir;

an anode assembly supported on the tank and extending into the fluid reservoir, the anode assembly including:

(a) first and second frame sections, each frame section including sides, a bottom, a top and extensions for resting on the tank and an opening formed therethrough and lying in a plane, portions of the frame sections surrounding the opening;

(b) first and second cation selective membranes;

(c) means for securing the first and second frame sections together along their sides and bottom, the first and second cation selective membranes secured therebetween with the first membrane extending over the opening in the first frame section and the second membrane extending over the opening in the second frame section; and (d) means for tensioning each membrane against the portions of the frame section about the opening across which the membrane extends to define an anode chamber within the anode assembly;

an anode including an anode bar extending across the tank above the anode chamber, at least one anode plate and at least one conductive strap to suspend the anode plate from the anode bar within the anode chamber of the anode assembly;

a cathode mounted on the tank, the cathode including a cathode bar extending across the tank, at least one cathode plate and at least one conductive strap to suspend the cathode plate from the cathode bar proximate the anode assembly;

means to selectively provide depleted chromium solution to either the lower portion of the anode chamber or the reservoir about the anode assembly;

means for establishing electrical potential between the anode and cathode for current flow therebetween to regenerate trivalent chromium to hexavalent chromium in the anode chamber, the regenerated chromium solution rising above the depleted chromium solution; and means for draining the regenerated chromium solution from the anode chamber.

7. The tank of claim 6 having a rim surrounding the reservoir, the extensions on the anode assembly resting on said rim to support the anode assembly on the tank, a trough being formed in the tank isolated from the reservoir, the regenerated chromium solution draining from the anode chamber to the trough for recovery.

* * * * *